US008353729B2

(12) United States Patent
Dabov et al.

(10) Patent No.: US 8,353,729 B2
(45) Date of Patent: Jan. 15, 2013

(54) LOW PROFILE CONNECTOR SYSTEM

(75) Inventors: Teo Dabov, San Francisco, CA (US); Cameron Frazier, San Carlos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 12/708,468

(22) Filed: Feb. 18, 2010

(65) Prior Publication Data

US 2011/0201213 A1 Aug. 18, 2011

(51) Int. Cl.
*H01R 24/04* (2006.01)

(52) U.S. Cl. ..... 439/668; 439/669

(58) Field of Classification Search ..... 439/95, 439/101, 188, 607.43, 668, 669, 939
See application file for complete search history.

(56) References Cited

U.S. PATENT DOCUMENTS

| | | | | |
|---|---|---|---|---|
| 4,516,822 | A * | 5/1985 | Wolfel | 439/468 |
| 5,863,221 | A | 1/1999 | Castaldo | |
| 6,231,396 | B1 * | 5/2001 | Huang | 439/668 |
| 6,270,380 | B1 | 8/2001 | Shichida et al. | |
| 6,461,199 | B1 | 10/2002 | Koga et al. | |
| 6,592,408 | B2 | 7/2003 | Ma et al. | |
| 7,217,163 | B2 | 5/2007 | Landgraf et al. | |
| 7,285,024 | B1 * | 10/2007 | Tai | 439/668 |
| 7,407,416 | B1 | 8/2008 | Rogers et al. | |
| 7,470,858 | B2 | 12/2008 | McNutt et al. | |
| 7,530,953 | B2 * | 5/2009 | Harshman et al. | 600/463 |
| 7,559,800 | B2 * | 7/2009 | Wu | 439/607.3 |
| 7,800,360 | B2 * | 9/2010 | Johansson et al. | 324/207.25 |
| 7,854,633 | B2 | 12/2010 | Lynch et al. | |
| 7,942,705 | B2 * | 5/2011 | Murphy et al. | 439/668 |
| 2002/0037669 | A1 * | 3/2002 | D'Addario | 439/669 |
| 2002/0193006 | A1 | 12/2002 | Ma et al. | |
| 2007/0149062 | A1 * | 6/2007 | Long et al. | 439/668 |
| 2007/0178771 | A1 | 8/2007 | Goetz et al. | |
| 2009/0149081 | A1 | 6/2009 | Zhu et al. | |
| 2010/0022118 | A1 * | 1/2010 | Zhang et al. | 439/490 |
| 2010/0062656 | A1 | 3/2010 | Lynch et al. | |
| 2010/0112871 | A1 * | 5/2010 | Yin | 439/669 |
| 2011/0059657 | A1 | 3/2011 | Lynch et al. | |
| 2011/0195611 | A1 * | 8/2011 | Little et al. | 439/668 |

FOREIGN PATENT DOCUMENTS

| | | | |
|---|---|---|---|
| JP | 04-118879 | A | 4/1992 |
| WO | WO 2009/091495 | A2 | 7/2009 |

OTHER PUBLICATIONS

U.S. Appl. No. 12/943,272, filed Nov. 10, 2010, Lynch et al.

* cited by examiner

*Primary Examiner* — Thanh Tam Le
(74) *Attorney, Agent, or Firm* — Kilpatrick Townsend & Stockton LLP

(57) ABSTRACT

A low profile connector system. In one set of embodiments, a low profile plug receptacle is provided that is thinner than a standard plug receptacle, thereby allowing the plug receptacle to be incorporated in small form factor (e.g., very thin) electronic devices while maintaining compatibility with standard plug connectors. In another set of embodiments, different types of custom plug connectors are provided that can improve the aesthetics of an electronic device housing the low profile plug receptacle when the custom plug connector is attached. In another set of embodiments, features are provided for preventing a plug connector from unintentionally falling out of, or coming loose from, the low profile plug receptacle and/or preventing a plug connector from rotating within the receptacle.

9 Claims, 11 Drawing Sheets

LOW PROFILE CONNECTOR SYSTEM

CROSS-REFERENCES TO RELATED APPLICATIONS

The present application is related to U.S. patent application Ser. No. 12/205,333 titled "Low Profile Plug Receptacle," filed Sep. 5, 2008, now U.S. Pat. No. 7,854,633, issued Dec. 21, 2010, which is incorporated herein by reference in its entirety for all purposes.

BACKGROUND

Embodiments of the present invention relate generally to connector systems, and in particular to a low profile connector system that can be used with small form factor electronic devices.

Standard audio plug connectors (or "audio plugs") include a cylindrical plug and are available in three sizes according to the diameter of the plug: a 6.35 mm (¼") size, a 3.5 mm (⅛") "miniature" size, and a 2.5 mm (3/32") "subminiature" size. Generally speaking, these connectors have conductive regions along portions of the plug known as the tip, ring, and sleeve, and are thus often referred to as TRS (tip, ring, sleeve) connectors.

FIG. 1 is a perspective view of a standard audio plug connector 100 having a connector body 102 and a cylindrical plug 104. In this example, plug 104 includes three conductive regions: a conductive tip 106, a conductive ring 108, and a conductive sleeve 110. Other types of plug connectors can have more or fewer conductive regions. Conductive regions 106, 108, and 110 are electrically isolated by insulating rings 112 and 114. If standard audio plug connector 100 is a 3.5 mm miniature connector, the diameter of plug 104 (at its thickest section) will be 3.5 mm.

A standard audio plug receptacle (or "audio jack") that is used to couple standard audio plug connector 100 to an electronic device has a circular opening through which plug 104 is inserted and an interior passage sized to receive the plug. Taking into account the thickness of the receptacle housing in which the opening is formed, as well as an appropriate amount of clearance for the plug to slide into the receptacle, a standard audio plug receptacle for a 3.5 mm audio plug connector generally has a thickness that is greater than 3.5 mm. As electronic devices (such as portable media players, cellular phones, portable computing devices, and the like) become smaller and thinner, the plug diameter of standard audio plug connectors (and the thickness of their corresponding receptacles) can be a limiting factor in reducing device thickness. While it is possible to develop an audio plug connector and receptacle that uses a smaller plug diameter than, for example, the standard 3.5 mm miniature size, such a connector system would not be backward compatible with the multitude of existing devices and accessories that are designed with the 3.5 mm size in mind.

BRIEF SUMMARY

Embodiments of the present invention provide a low profile connector system. In one set of embodiments, the low profile connector system includes a low profile plug receptacle having at least a front side and a top side, where the front side can include a first, partially circular opening that extends into a longitudinal passage inside the receptacle, and where the top side can include a second, elongated opening that intersects the first opening and that extends perpendicularly into the longitudinal passage. In certain embodiments, the width of the second opening can be equal to the width of the first opening. When a plug connector is inserted into the low profile plug receptacle, the plug of the plug connector can extend partially through the second opening. With this type of design, the thickness of the low profile plug receptacle can be made smaller than standard plug receptacles, thereby allowing the low profile plug receptacle to be incorporated in small form factor (e.g., very thin) electronic devices, while maintaining compatibility with standard (e.g., 3.5 mm) plug connectors.

In another set of embodiments, the low profile connector system can include different types of custom plug connectors that are adapted to mate with the low profile plug receptacle described above. For example, one type of custom plug connector can include a cosmetic cap that is coupled with the connector plug and/or the connector body. When the custom plug connector is inserted into the low profile plug receptacle, the cosmetic cap can at least partially cover the second opening of the receptacle (including the portion of the plug extending through the second opening). In certain embodiments, the outer surface of the cosmetic cap can be configured to be similar in appearance to an outer surface of an electronic device housing the low profile plug receptacle. In this manner, the cosmetic cap can improve the aesthetics of the device when the custom plug connector is attached.

Another type of custom plug connector can include a plug that is shaped to match the longitudinal passage inside the low profile plug receptacle. For instance, if the second opening causes the longitudinal passage to be partially cylindrical (rather than fully cylindrical) in shape, the plug of the custom plug connector can also be partially cylindrical in shape. Thus, the custom plug connector can be inserted into the low profile plug receptacle in such a way that no portion of the plug extends through the second opening. This also can improve the aesthetics the electronic device housing the receptacle.

In another set of embodiments, the low profile connector system can include features for preventing a plug connector from unintentionally falling out of, or coming loose from, the low profile plug receptacle and/or preventing a plug connector from rotating within the receptacle. For example, in embodiments where the plug connector can be customized, the low profile plug receptacle can include a magnet and the custom plug connector can include a ferrous attractor (or vice versa). When the custom plug connector is inserted into the low profile plug receptacle, the magnetic attraction between the magnet and ferrous attractor can cause the plug connector to be held in place.

In another embodiment, the low profile plug receptacle can include one or more cutouts along the interior surface of the longitudinal passage and the custom plug connector can include one or more matching features that protrude from the plug and/or connector body. When the custom plug connector is inserted into the low profile plug receptacle, the protruding features can fit into the cutouts in the longitudinal passage, thereby preventing the plug from rotating.

In embodiments where the plug connector can be a standard connector (e.g., a 3.5 mm miniature connector), the low profile connector system can include an adapter that is separate from either the low profile plug receptacle or the standard plug connector, and can be configured to attach onto or around one or more outer walls of an electronic device in which the low profile plug receptacle is housed. When the adapter is attached, the adapter can provide structural support that prevents the standard plug connector from unintentionally coming loose from the low profile plug receptacle, thereby providing improved compatibility with such standard connectors.

A further understanding of the nature and advantages of embodiments of the present invention may be realized by reference to the remaining portions of the specification and the drawings.

DETAILED DESCRIPTION

In the following description, for the purposes of explanation, numerous details are set forth in order to provide an understanding of various embodiments of the present invention. It will be apparent, however, to one skilled in the art that certain embodiments can be practiced without some of these details.

Embodiments of the present invention provide a low profile connector system. In one set of embodiments, a low profile plug receptacle is provided that is thinner than a standard plug receptacle, thereby allowing the low profile plug receptacle to be incorporated in small form factor (e.g., very thin) electronic devices while maintaining compatibility with standard (e.g., 3.5 mm) plug connectors. In another set of embodiments, different types of custom plug connectors are provided that can improve the aesthetics of an electronic device housing the low profile plug receptacle when the custom plug connector attached. In another set of embodiments, features are provided for preventing a plug connector from unintentionally falling out of, or coming loose from, the low profile plug receptacle and/or preventing a plug connector from rotating within the receptacle.

Figure 1:
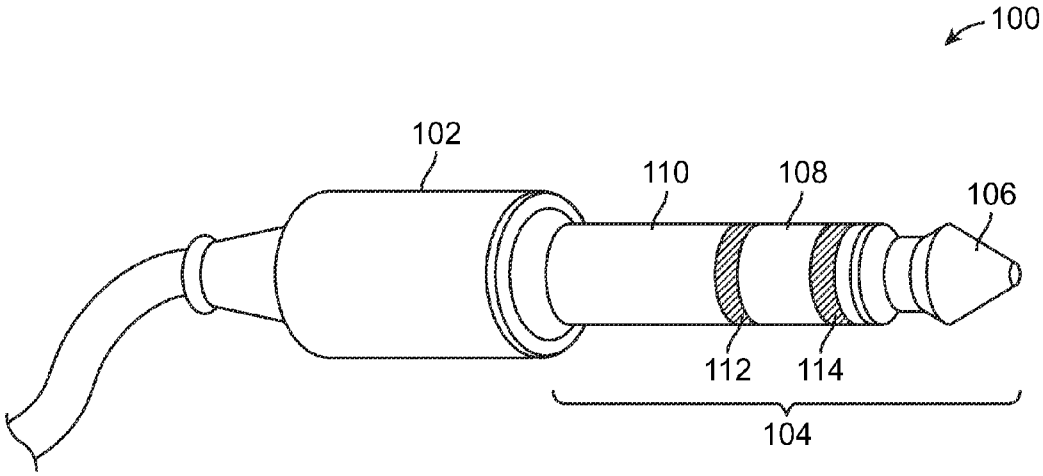
FIG. 1 illustrates a standard audio plug connector that can be used with embodiments of the present invention.
Figure 2A:
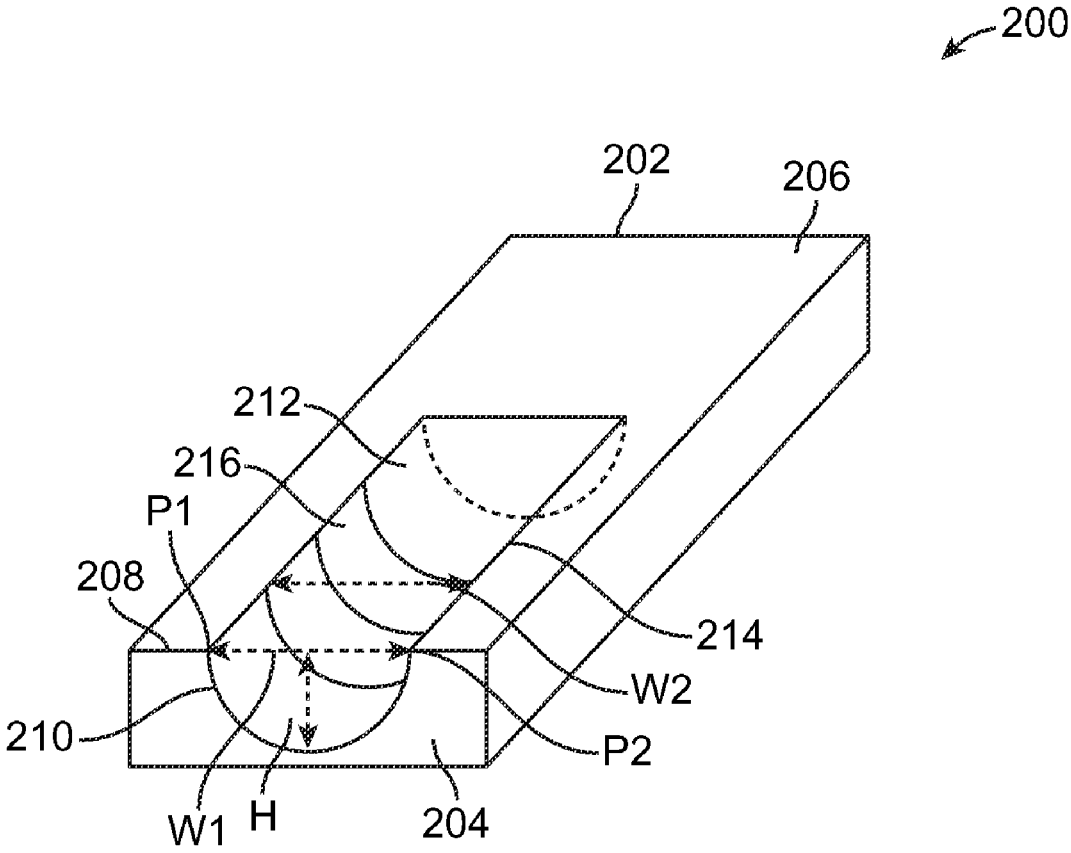
FIGS. 2A-2C illustrate various low profile plug receptacles according to embodiments of the present invention.

FIG. 2A is a perspective view of a low profile plug receptacle 200 according to an embodiment of the present invention. Low profile plug receptacle 200 can be any type of receptacle that is capable of receiving (and providing electrical connections to) a corresponding plug connector. In certain embodiments, low profile plug receptacle 200 can be an audio plug receptacle that is configured to receive a standard audio plug connector, such as connector 100 of FIG. 1.

As shown, low profile plug receptacle 200 can include a receptacle housing 202, which can be constructed from various non-conducting materials, such as plastic. Receptacle housing 202 can include a front side 204 and a top side 206. It should be appreciated that the phrases "front side" and "top side" (as well as any other similar phrases used herein) are relative, and are not intended to limit embodiments of the present invention. For example, front side 204 and top side 206 can be any two sides of receptacle housing 202 that are adjacent (i.e., share an edge). In the embodiment of FIG. 2A, front side 204 and top side 206 share an edge 208.

Front side 204 can include a first, partially circular opening 210 that is disposed along edge 208 and that extends into a longitudinal passage 212 within receptacle housing 202. First opening 210 can have a height H corresponding to the maximum vertical distance between edge 208 and a perimeter point of first opening 210. In addition, first opening 210 can have a width W1 corresponding to the maximum horizontal distance between two perimeter points of the opening. In the embodiment of FIG. 2A, first opening 210 forms a semi-circle, and width W1 of first opening 210 is equal to the distance between the points at which the perimeter of first opening 210 meets edge 208 (points P1 and P2).

Figure 2B:
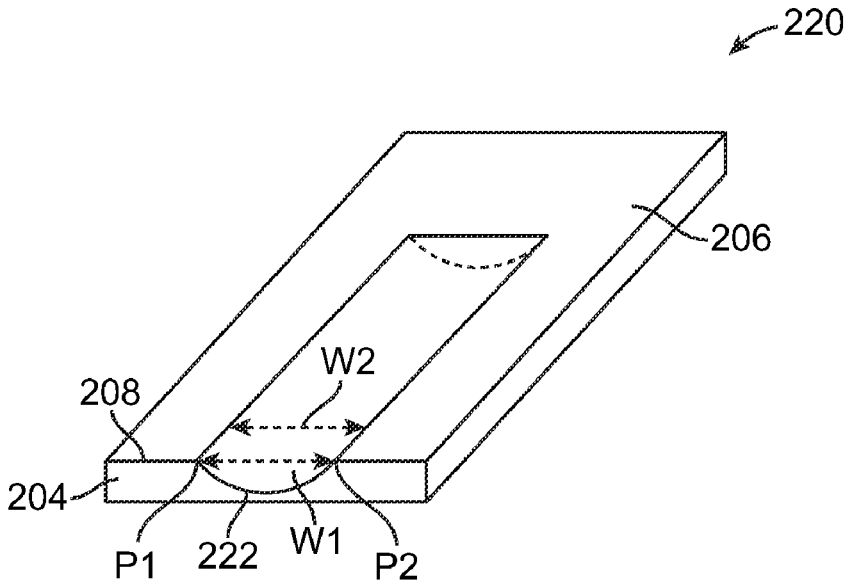
Figure 2C:
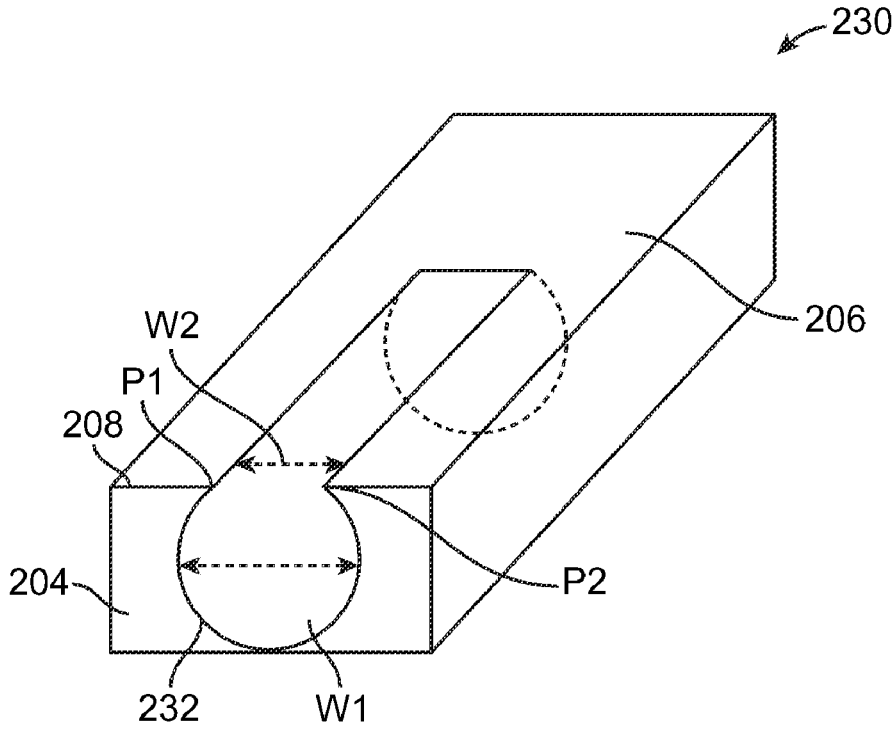

In other embodiments, the size of the first opening can vary. For example, FIG. 2B illustrates a variation of plug receptacle 200 (receptacle 220) where the first, partially circular opening on front side 204 (opening 222) forms an area less than a semi-circle. In this embodiment, width W1 of first opening 222 is also equal to the distance between the points at which the perimeter of the opening meets edge 208 (P1 and P2). FIG. 2C illustrates another variation of plug receptacle 200 (receptacle 230) where the first, partially circular opening on front side 204 (opening 232) forms an area greater than a semi-circle. In this embodiment, width W1 of first opening 232 (in this case, the diameter of the opening) is greater than the distance between the points at which the perimeter of the opening meets edge 208 (P1 and P2).

Returning to FIG. 2A, top side 206 can include a second, elongated opening 214 that extends perpendicularly into longitudinal passage 212 and that intersects first opening 210 at edge 208. As shown, second opening 214 can have a width W2. In the embodiments of FIGS. 2A and 2B, width W2 can be equal to width W1. In the embodiment of FIG. 2C, width W2 can be less then width W1.

Longitudinal passage 212 can include one or more electrical contacts 216 disposed within, which can be spring contacts or other appropriate contacts. The number of contacts can correspond to the type of plug connector for which the low profile plug receptacle is used. In one embodiment, electrical contacts 216 can include four individual contacts for ground, left audio channel, right audio channel, and video. In other embodiments, electrical contacts 216 can include more or less contacts or contacts for different connections altogether. Additionally, electrical contacts 216 can be compatible with plug connectors that include fewer conductive regions than the number of contacts. For example, a low profile plug receptacle having four electrical contacts 216 can be compatible with an audio plug connector having only three conductive regions for left audio, right audio, and ground.

Low profile plug receptacle 200 can be configured to receive any type of plug connector by having its dimensions, including dimensions H, W1, and W2, scaled accordingly. In situations where low profile plug receptacle 200 is adapted for use with standard 3.5 mm miniature audio plug connectors, height H can be less than 3.5 mm and widths W1 and W2 can be equal to or slightly larger than 3.5 mm (e.g., 3.6 mm). In another embodiment, widths W1 and W2 can be less than 3.5 mm. In yet another embodiment, width W1 can be equal to or slightly larger than 3.5 mm, and width W2 can be less than 3.5 mm.

In use, a plug of a plug connector (e.g., plug 104 of FIG. 1) can be inserted into longitudinal passage 212 of low profile plug receptacle 200 through first opening 210. Alternatively, the plug can be inserted perpendicularly into longitudinal passage 212 through second opening 214. When a cylindrical plug is inserted, the plug can extend at least partially through second opening 214, and thus extend past the surface of top side 206. With this type of design, the thickness of plug receptacle 200 can be less than a standard plug receptacle (and possibly less than the diameter of a standard plug connector). Accordingly, low profile plug receptacle 200 can be implemented to reduce the thickness of an electronic device, while maintaining compatibility with standard (e.g., 3.5 mm) plug connectors.

Figure 3A:
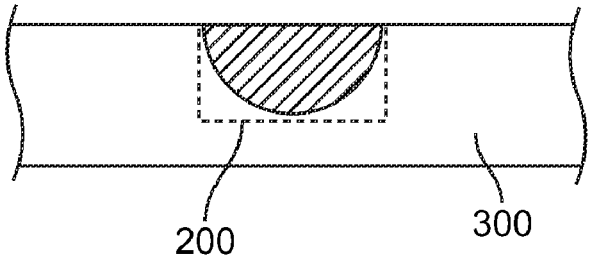
FIGS. 3A-3C illustrate various configurations for positioning a low profile plug receptacle within an electronic device according to embodiments of the present invention.

Further, the relative thinness of low profile plug receptacle 200 (as compared with standard plug receptacles) can provide greater flexibility in placing the receptacle within an electronic device. FIG. 3A is a frontal view of low profile plug receptacle 200 as incorporated into the body of an electronic device 300 according to an embodiment of the present invention. In this embodiment, low profile plug receptacle 200 is placed in a "middle" portion of device 300, such that the device body surrounds three sides of the receptacle (left, right, and bottom sides).

Figure 3B:
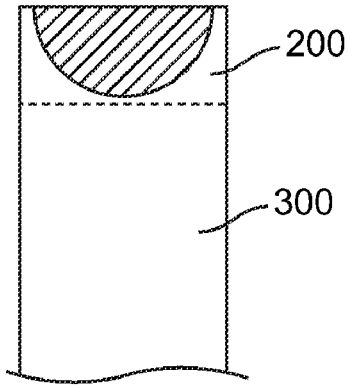

FIG. 3B illustrates another configuration where low profile plug receptacle 200 is placed at an "end" portion of electronic device 300. In this embodiment, the device body only extends from the bottom side of the receptacle.

Figure 3C:
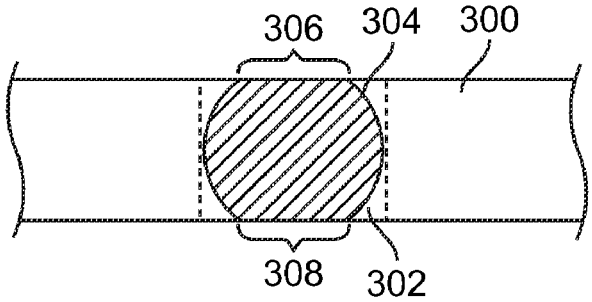

FIG. 3C is a frontal view of an alternative low profile plug receptacle 302 as incorporated into the body of electronic device 300 according to an embodiment of the present invention. Like low profile plug receptacle 230 of FIG. 2C, low profile plug receptacle 302 can include a first opening 304 on a front side and a second opening 306 on a top side. However, low profile plug receptacle 302 can also include a third opening 308 on a bottom side opposite the top side. In certain embodiments, third opening 308 can be similar (or identical) in size to second opening 306. In the embodiment shown, low profile plug receptacle 302 can be placed in a "middle" portion of electronic device 300, such that the device body surrounds two sides the receptacle (left and right sides). In this embodiment, a plug connector can be inserted into low profile plug receptacle 302 via any of the openings 304, 306, or 308. When a cylindrical plug is inserted, the plug can extend at least partially through both second opening 306 and third opening 308 (and thus extend past the top and bottom sides of device 300).

Figure 4:
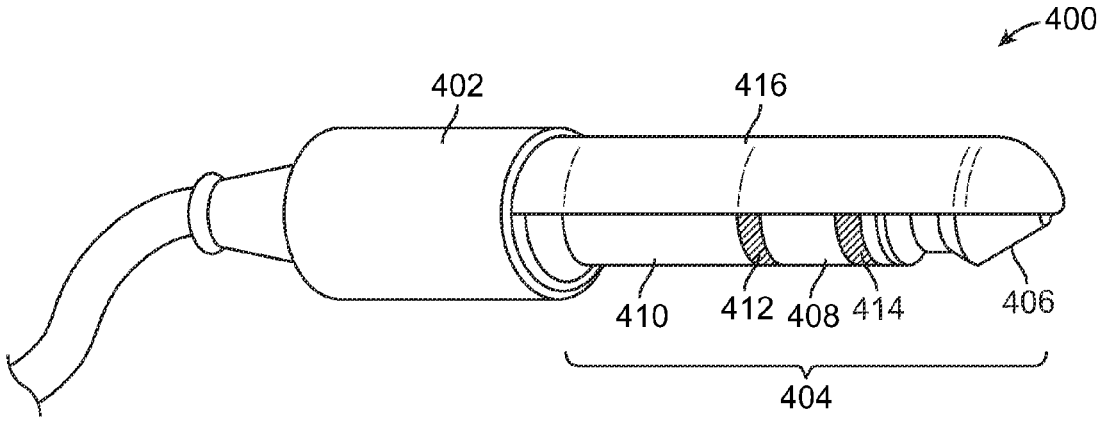
FIG. 4 illustrates a first type of custom plug connector according to an embodiment of the present invention.

FIG. 4 is a perspective view of a custom plug connector 400 that can be used with the low profile plug receptacles described above according to an embodiment of the present invention. Like standard plug connector 100 of FIG. 1, custom plug connector 400 can include a connector body 402 and a plug 404. Custom plug connector 400 can also include one or more conductive regions 406, 408, and 410 and insulating rings 412 and 414 along plug 404. Although only three conductive regions are shown, more or fewer regions can be supported. In one embodiment, plug 404 can be a standard 3.5 mm miniature audio plug.

Unlike standard plug connector 100, custom plug connector 400 can include a cosmetic cap 416. Cap 416 can be constructed from various non-conducting materials, such as plastic, and can be coupled with connector body 402, plug 404, or both. When custom plug connector 400 is inserted into, e.g., low profile plug receptacle 200 of FIG. 2A, cap 416 can at least partially cover second opening 214 on the top side of the receptacle. Accordingly, the portion of plug 404 that extends outward through second opening 214 can be hidden from view by the cap, thereby improving the aesthetics of an electronic device housing the receptacle. Additionally, cap 416 can prevent or minimize the influx of dust or other contaminants into the interior passage (e.g., passage 212) of the receptacle.

In one set of embodiments, the outer surface of cap 416 can be configured to match (or be similar to) the appearance of the outer surface of the electronic device housing the low profile plug receptacle. For example, the outer surface of cap 416 can have a similar shape, texture, color, etc. to the outer surface of the electronic device. In these embodiments, the aesthetics of the electronic device is further enhanced, since cap 416 can provide a seamless visual appearance to the exterior of the device when custom plug connector 400 is connected.

Figure 5A:
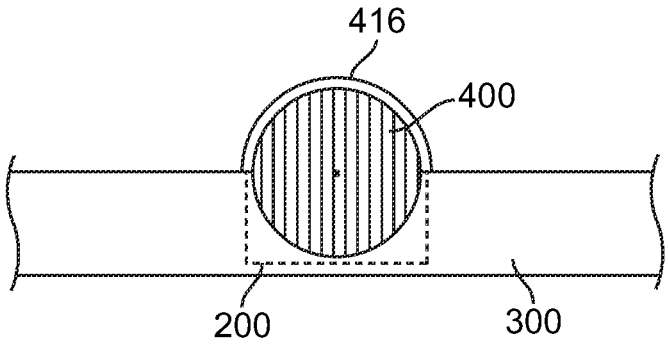
FIGS. 5A-5C illustrate the custom plug connector of FIG. 4 as mated with various low profile plug receptacles according to embodiments of the present invention.
Figure 5B:
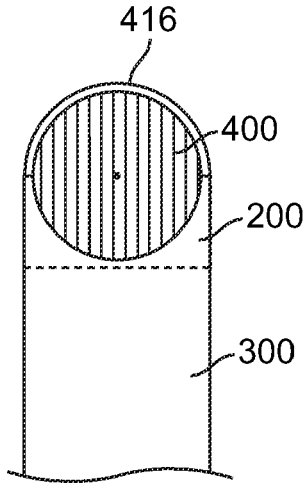

FIGS. 5A and 5B are cross-sectional views of custom plug connector 400 as mated with the low profile plug receptacles depicted in FIGS. 3A and 3B respectively. In each case, cap 416 is configured to cover the portion of the connector plug that extends outward via the second opening of the receptacle. It should be appreciated that the size of cap 416 can be scaled based on the size of the second opening (and thus, the amount of plug surface that will be exposed when the plug connector is attached). For example, plug receptacles 200, 220, and 230 of FIGS. 2A-2C each have a second opening that is different in width. Different versions of custom plug connector 400 (each having different cap sizes) can be used with these embodiments to ensure that the second opening is sufficiently covered.

Figure 5C:
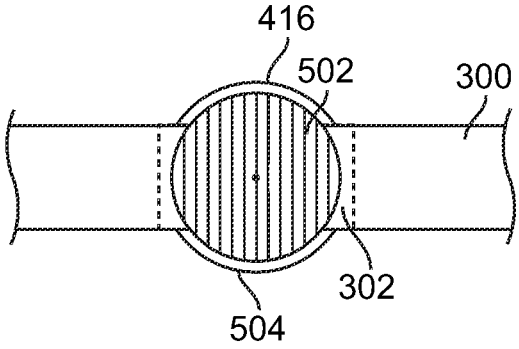

FIG. 5C is a cross-sectional view of a custom plug connector 502 as mated with low profile plug receptacle 302 of FIG. 3C. Connector 502 is similar to connector 400, but can include a second cosmetic cap 504 on the side of the plug opposite cap 416. Accordingly, the portions of the plug extending from openings 306 and 308 can both be covered.

Figure 6:
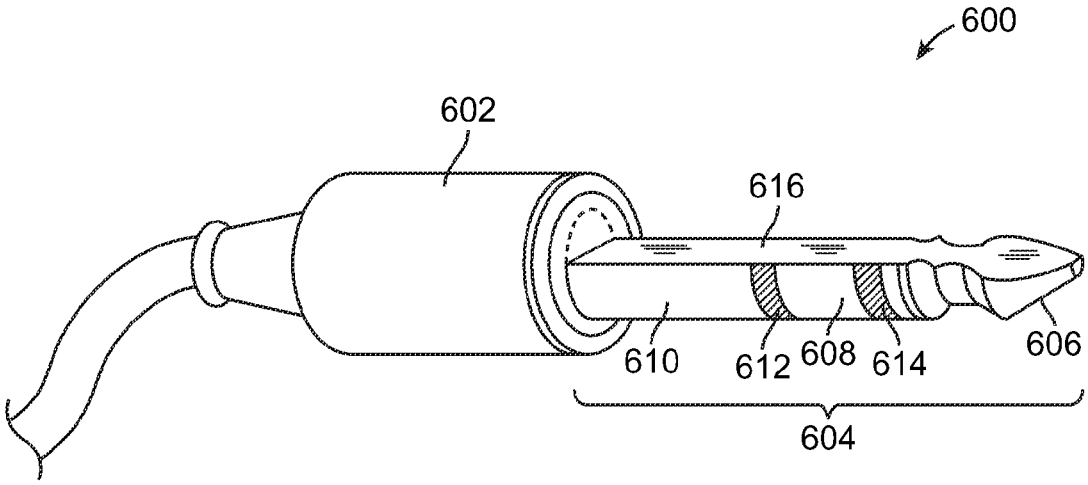
FIG. 6 illustrates a second type of custom plug connector according to an embodiment of the present invention.

FIG. 6 is a perspective view of another custom plug connector 600 that can be used with the low profile plug receptacles described above according to an embodiment of the present invention. Like standard plug connector 100 of FIG. 1, custom plug connector 600 can include a connector body 602 and a plug 604. Custom plug connector 600 can also include one or more conductive regions 606, 608, and 610 and insulating rings 612 and 614 along plug 604. Although only three conductive regions are shown, more or fewer regions can be supported. In one embodiment, plug 604 can have a cross-sectional width of approximately 3.5 mm.

Unlike standard plug connector 100, a portion of plug 604 (616) can be cut away along its longitudinal axis such that plug 604 matches the partially cylindrical shape of longitudinal passage 212 within low profile plug receptacle 200 of FIG. 2A. This modification allows custom plug connector 600 to be inserted into low profile plug receptacle 200 in an orientation where plug 604 does not extend outward through second opening 214. This, in turn, improves the aesthetics of an electronic device housing the receptacle, since there is no protrusion along the exterior of the device caused by the connected plug. In a particular embodiment, when plug connector 604 is mated with low profile plug receptacle 200, the surface of plug 604 can be flush with top side 206 across second opening 214.

Figure 7A:
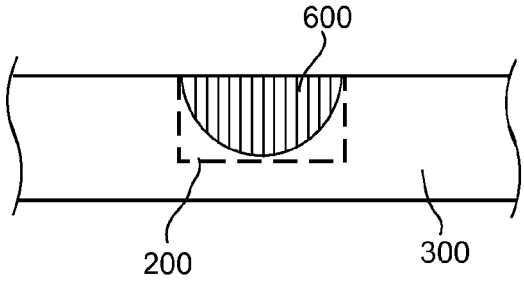
FIG. 7A-7D illustrate the custom plug connector of FIG. 6 as mated with various low profile plug receptacles according to embodiments of the present invention.
Figure 7B:
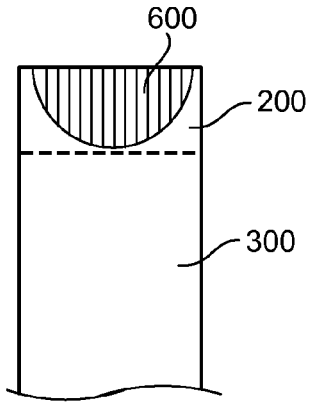

FIGS. 7A and 7B are cross-sectional views of custom plug connector 600 as mated with the low profile plug receptacles shown in FIGS. 3A and 3B respectively. In each case, custom plug connector 600 is oriented such that the plug does not extend outward through the second opening of the receptacle. It should be appreciated that shape of plug 604 can be modified to match different low profile plug receptacles having different interior dimensions. For example, low profile plug receptacles 200, 220, and 230 of FIGS. 2A-2C all have interior, longitudinal passages that are partially cylindrical in shape, but the passages differ in area. Variations of custom plug connector 600 can be shaped as appropriate to fully occupy the interior space of receptacles 200, 220, and 230 respectively (without extending past the second opening of the receptacle).

Figure 7C:
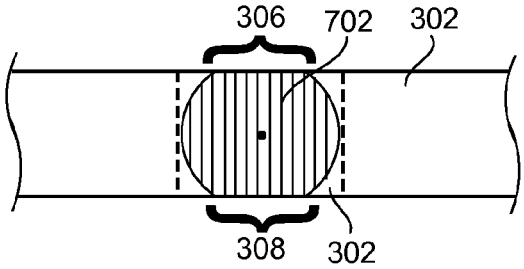

FIG. 7C is a cross-sectional view of a custom plug connector 702 as mated with low profile plug receptacle 302 of FIG. 3C. Connector 702 is similar to connector 600, but can include a second cut away portion on the side of the plug opposite first cut away portion 616. Accordingly, custom plug connector 702 can be inserted into low profile plug receptacle 302 without extending through either opening 306 or opening 308.

Figure 7D:
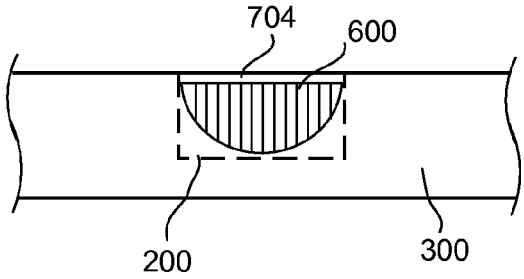

Certain embodiments of the present invention can combine various features of custom plug connector 400 and custom plug connector 600 into a single custom plug connector. For example, a third type of custom plug connector can include a cosmetic cap (e.g., cap 416 of connector 400) that covers a cut away portion of the plug (e.g., portion 616 of connector 600). When inserted into a low profile plug receptacle such as receptacle 200 of FIG. 2A, the connector can be oriented such that the connector plug 10 does not extend beyond second opening 214. Further, the portion of the plug that would typically be visible through second opening 214 can be covered by the cosmetic cap. In a particular embodiment, the cosmetic cap can sit flush with an outer wall of an electronic device housing the low profile plug receptacle. See for example, FIG. 7D, where a cosmetic cap 704 is configured to sit flush with an outer wall of electronic device 300 when plug connector 600 is inserted into receptacle 200. Thus, this type of custom plug connector can enhance the aesthetics of the electronic device by providing both (1) a uniform exterior appearance (via the cosmetic cap) and (2) a uniform exterior shape (via the cut away plug) for the device when the plug connector is attached.

Figure 8:
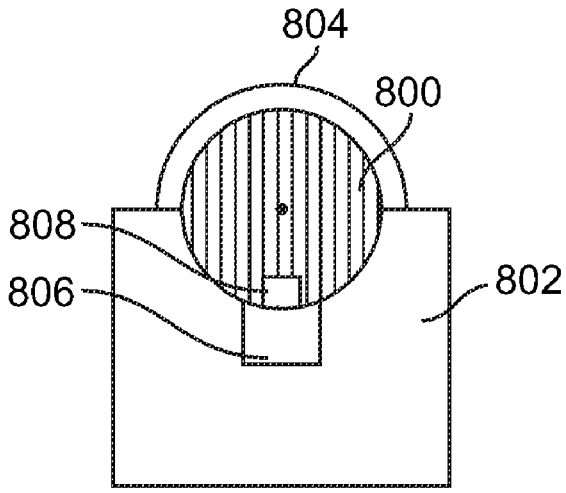
FIG. 8 illustrates a magnetic retention mechanism according to an embodiment of the present invention.

In addition to the low profile plug receptacles and custom plug connectors described above, certain embodiments of the present invention provide retention and/or anti-rotation mechanisms for holding a plug connector in place when inserted into a low profile plug receptacle. FIG. 8 is a cross-sectional view of a plug connector 800 mated with a low profile plug receptacle 802 that illustrates a magnetic retention mechanism according to an embodiment of the present invention. In the embodiment shown, plug connector 800 is similar in general construction to custom plug connector 400 of FIG. 4. For example, plug connector 800 can include a cosmetic cap 804. Low profile plug receptacle 802 is similar in general construction to receptacle 200 of FIG. 2A.

In various embodiments, low profile plug receptacle 802 can include a magnet 806 and plug connector 800 can include a ferrous attractor 808 (e.g., a ferromagnetic material such as steel). In one embodiment, the ferrous attractor 808 can be a discrete object embedded in the plug and/or connector body of plug connector 800. In another embodiment, ferrous attractor 808 can be integrated into the structure of the plug or connector body; for instance, the entire plug can be constructed of a ferromagnetic material. When plug connector 800 is inserted into low profile plug receptacle 802, the magnetic attraction between magnet 806 and ferrous attractor 808 can prevent plug connector 800 from falling out of (or otherwise coming loose from) plug receptacle 800.

It should be appreciated that the embodiment illustrated in FIG. 8 is exemplary and that numerous modifications are possible. For example, the positions of magnet 806 and ferrous attractor 808 can be swapped, such that magnet 806 is included in plug connector 800 and ferrous attractor 808 is included in low profile plug receptacle 802. Further, although plug connector 800 is depicted as being similar to custom plug connector 400 of FIG. 4 and low profile plug receptacle 802 is depicted as being similar to receptacle 200 of FIG. 2A, any combination of plug connectors and plug receptacles disclosed herein can employ the magnetic retention mechanism shown in FIG. 8. One of ordinary skill in the art will recognize many variations, modifications, and alternatives.

Figure 9:
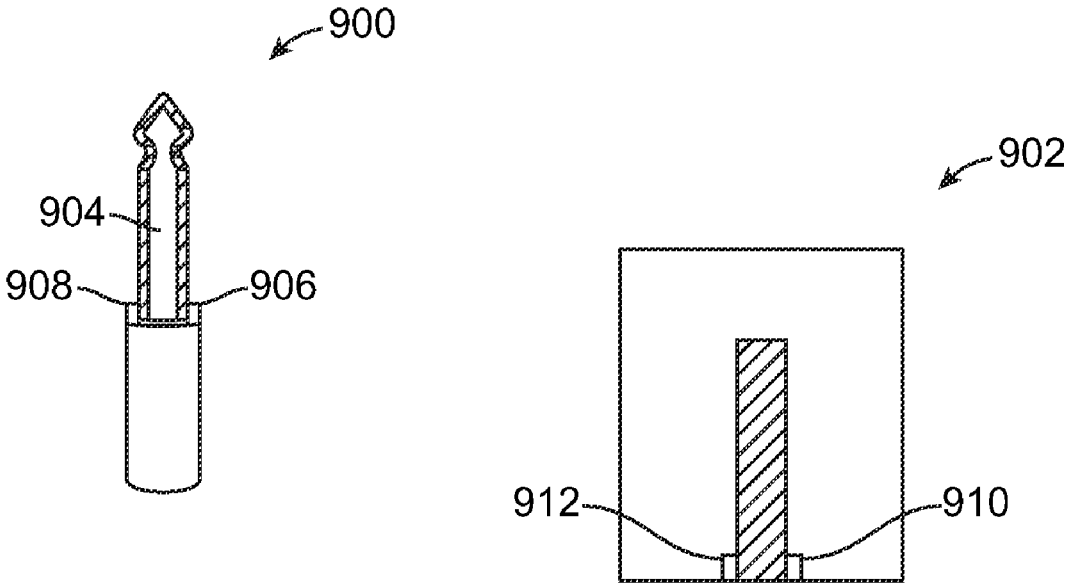
FIG. 9 illustrates an anti-rotation mechanism according to an embodiment of the present invention.

FIG. 9 is a top-down view of a plug connector 900 and a low-profile plug receptacle 902 that illustrates an anti-rotation mechanism according to an embodiment of the present invention. In the embodiment shown, plug connector 900 is similar in general construction to custom plug connector 600 of FIG. 6. For example, the plug of plug connector 900 can be partially cylindrical in shape and can include a cut away portion 904. Low profile plug receptacle 902 is similar in general construction to receptacle 200 of FIG. 2A.

In various embodiments, plug connector 900 can include one or more projecting features 906 and 908 and low profile plug receptacle 902 can include one or more matching cutouts 910 and 912. When plug connector 900 is inserted into low profile plug receptacle 902, features 906 and 908 can fit into cutouts 910 and 912, thereby preventing the plug of connector 900 from rotating. In one set of embodiments, projecting features 906 and 908 can hold plug connector 900 in an orientation where cut away portion 904 is parallel to the second opening on the top side of low profile plug receptacle 902, thus preventing the plug from extending through the second opening.

It should be appreciated that the embodiment illustrated in FIG. 9 is exemplary and that numerous modifications are possible. For example, although only two projecting features (906, 908) and matching cutouts (910, 912) are shown, any number can be supported. Further, features 906 and 908 can be positioned at any section along the plug or connector body of plug connector 900. Yet further, the anti-rotation mechanism shown in FIG. 9 can be implemented in any of the plug connectors and plug receptacles disclosed herein, and in combination with any other retention or anti-rotation mechanism (such as the magnetic retention mechanism of FIG. 8). One of ordinary skill in the art will recognize many variations, modifications, and alternatives.

Figure 10A:
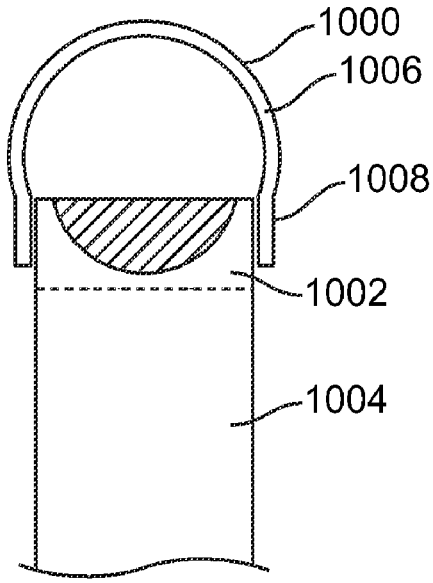
FIGS. 10A and 10B illustrate an adapter for retaining a standard plug connector in a low profile plug receptacle according to an embodiment of the present invention.

In some cases, a plug connector may not support the retention and anti-rotation mechanisms described with respect to FIGS. 8 and 9. For example, a standard 3.5 mm audio plug connector generally will not include a ferrous attractor as depicted in FIG. 8 or projecting features as depicted in FIG. 9. To address this, an adapter can be provided for retaining a standard plug connector in place within a low profile plug receptacle. FIG. 10A is a frontal view of such an adapter (1000) as mated with a low profile plug receptacle 1002 according to an embodiment of a present invention. In this particular embodiment, low profile plug receptacle 1002 is similar in general construction to receptacle 200 of FIG. 2A and is placed at an end portion of an electronic device 1004.

As shown, adapter 1000 can include a body section 1006 and clip section 1008. Body section 1006 can be partially cylindrical in shape and, when positioned next to low profile plug receptacle 1002, can form a fully cylindrical cavity for receiving the plug of a standard plug connector (e.g., connector 100 of FIG. 1). Thus, when a standard plug connector is inserted into low profile plug receptacle 1002, body section 1006 can provide structural support that prevents the plug connector from unintentionally coming loose from the receptacle. In a particular embodiment, the diameter of the cylindrical cavity formed by body section 1006 and low profile plug receptacle 1002 can be equal to or slightly greater than 3.5 mm.

Clip section 1008 is configured to attach adapter 1000 to the outer walls of low profile plug receptacle 1002 and/or electronic device 1004. In one set of embodiments, clip section 1008 can hold adapter 1000 in place by exerting an elastic force against the walls of receptacle 1002 or electronic device 1004 (e.g., via a spring or other means). In another set of embodiments, clip section 1008 can include a ferrous attractor that is attracted to a magnet 15 resident in receptacle 1002 or electronic device 1004.

In certain embodiments, the outer surface of adapter 1000 can be configured to match (or be similar to) the appearance of the outer surface of electronic device 1004. For example, the outer surface of adapter 1000 can have a similar shape, texture, color, etc. to the outer surface of electronic device 1004. Accordingly, in these embodiments adapter 1000 can provide a seamless visual appearance to the exterior of the device when the adapter is attached.

Figure 10B:
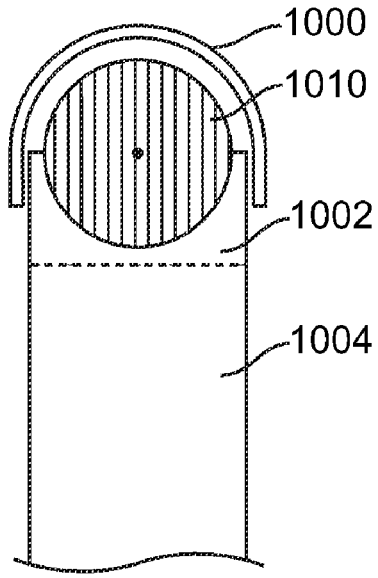

FIG. 10B is a cross-sectional view illustrating a standard plug connector 1010 as mated with low profile plug receptacle 1002 and retained by adapter 1000.

It should be appreciated that the embodiments illustrated in FIGS. 10A and 10B are exemplary and that numerous modifications are possible. For example, although adapter 1000 is shown as attaching to an end section of electronic device 1004, adapter 100 can be configured to attach to any other section of device 1004 where low profile plug receptacle 1002 may be located. One of ordinary skill in the art will recognize many variations, modifications, and alternatives.

Figure 11:
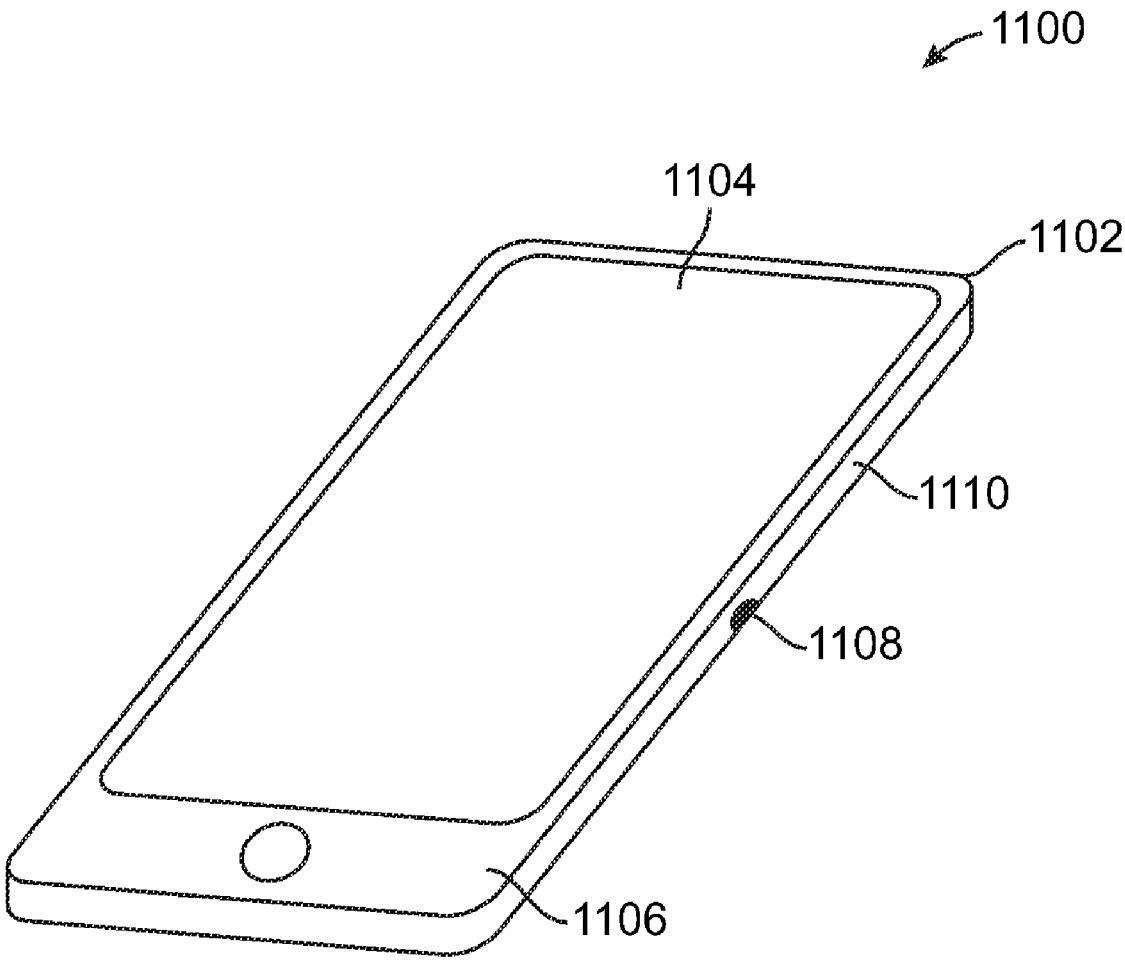
FIG. 11 illustrates an electronic device according to an embodiment of the present invention.

FIG. 11 illustrates an electronic device 1100 according to an embodiment of the present invention. In one set of embodiments, electronic device 1100 can be a portable electronic communication or media device such as the iPhone, iPod Touch, or iPod Nano manufactured by Apple Inc.

Electronic device 1100 can include one or more processors, communications buses, and memories (not shown). In certain embodiments, electronic device 1100 can operate as a mobile phone and/or a media playing/recording device. For example, electronic device 1100 can include a storage device for storing media assets (e.g., music, video, etc.) and a processing component for playing back the media assets. As shown, electronic device 1100 can include a housing 1102 that includes a display screen 1104 on side 1106, and a low profile plug receptacle 1108 on an adjacent side 1110. In one embodiment, side 1110 can have a thickness of 5 mm or less. In another embodiment, side 1110 can have a thickness of 3.5 mm or less. Low profile plug receptacle 1108 can be similar in general construction to any of the low profile plug receptacles described above.

As will be understood by those skilled in the art, the present invention can be embodied in other specific forms without departing from the essential characteristics thereof. Those skilled in the art will recognize, or be able to ascertain using no more than routine experimentation, many equivalents to the specific embodiments of the invention described herein. Such equivalents are intended to be encompassed by the following claims.

What is claimed is:

1. An electronic device-comprising:

a device housing that defines a shape and size of the electronic device;

a processor positioned within the device housing; and an audio receptacle connector having an interior, longitudinal passage configured to receive a plug of a plug connector within the device housing the longitudinal passage opening to a first, partially circular opening at a first exterior surface of the device housing-and to a second, elongated opening at a second exterior surface of the device housing, wherein the second opening intersects the first opening and extends perpendicularly into the longitudinal passage, and wherein the width of the second opening is equal to the width of the first opening where the first and second openings intersect.

2. The electronic device of claim 1 wherein the width of the first opening and the width of the second opening is approximately 3.5 millimeters.

3. The electronic device-of claim 1 wherein the width of the first opening and the width of the second opening is less than 3.5 millimeters.

4. The electronic device-of claim 1 wherein the height of the first opening is less than 3.5 millimeters.

5. The electronic device of claim 1 wherein when the plug of the plug connector is inserted into the interior, longitudinal passage, the plug extends at least partially through the second opening.

6. The electronic device of claim 1 wherein a thickness of the electronic device is less than 5 millimeters.

7. The electronic device of claim 1 wherein the audio receptacle connector further comprises a magnet configured to attract a ferrous attractor coupled to the plug connector, thereby holding the plug connector in place when the plug is inserted into the interior, longitudinal passage.

8. The electronic device of claim 1 wherein the audio receptacle connector includes one or more cutouts along an interior surface of the longitudinal passage that are configured to receive one or more projections extending from the plug, thereby preventing the plug connector from rotating when the plug is inserted into the longitudinal passage.

9. A portable electronic device comprising:

a storage device configured to store media assets;

a processor configured to play back media assets; and a device housing comprising:

a first side including a first, partially circular opening at an exterior surface of the housing that extends into a longitudinal passage configured to receive a plug of a 3.5 mm audio plug connector; and a second side that shares an edge with the first side, the second side including a second, elongated opening at the exterior surface of the housing that intersects the first opening and that extends perpendicularly into the longitudinal passage, wherein the width of the second opening is to equal the width of the first opening where the first opening meets the second opening.

* * * * *